United States Patent [19]

Kreischer

[11] 4,082,684

[45] Apr. 4, 1978

[54] LIQUID DETERGENT

[75] Inventor: Pieter Hubertus Kreischer, Schiedam, Netherlands

[73] Assignee: Lever Brothers Company, New York, N.Y.

[21] Appl. No.: 680,953

[22] Filed: Apr. 28, 1976

[30] Foreign Application Priority Data

Apr. 29, 1975 United Kingdom ..... 17789/75

[51] Int. Cl.[2] ..... C11D 15/04; C11D 3/06

[52] U.S. Cl. ..... 252/109; 252/116; 252/121; 252/132; 252/173; 252/540; 252/DIG. 14

[58] Field of Search ..... 252/109, 116, 121, 132, 252/173, 540, DIG. 14

[56] References Cited

U.S. PATENT DOCUMENTS

| | | | |
|---|---|---|---|
| 3,156,655 | 11/1964 | Bright | 252/109 |
| 3,203,900 | 8/1965 | Carroll et al. | 252/109 X |
| 3,707,503 | 12/1972 | Kenny | 252/DIG. 14 |
| 3,784,476 | 1/1974 | Van Karpen | 252/109 |

*Primary Examiner*—Mayer Weinblatt

*Attorney, Agent, or Firm*—Michael J. Kelly; Melvin H. Kurtz; James J. Farrell

[57] ABSTRACT

A stable aqueous built liquid detergent composition is prepared comprising a potassium alkylbenzenesulphonate, a potassium fatty acid soap, a nonionic detergent material, a neutralized maleic anhydride copolymer, partially esterified with a nonionic detergent active, and sodium-tripolyphosphate.

6 Claims, No Drawings

LIQUID DETERGENT

The present invention relates to a liquid detergent composition, and more particularly to an aqueous built liquid detergent composition in which the builder is or comprises an alkalimetaltripolyphosphate.

Aqueous built liquid detergent compositions are well-known in the art. Although they offer several advantages over other forms of detergent compositions like powders, such as improved solubility and easier dosing, their formulation is rather difficult, since they should be physically stable and have a satisfactory pourability. These formulation difficulties are well represented by the numerous proposals made over the past decades in the prior art concerning stable and pourable built liquid detergent compositions. Particularly aqueous built liquid detergent compositions are not so easy to formulate, as these contain relatively high amounts of solid material, such as builder salts. This creates a stability problem, the solution of which may in its turn create a pourability problem.

The prior art mainly teaches the use of more water-soluble ingredients, such as tetrapotassium pyrophosphate, in compositions which are mainly based on a nonionic detergent active material. Such systems can be stabilized with the aid of a polymeric stabilizing agent. Variations of these formulae involve the use of an additional amount of a fatty acid soap or an anionic detergent active agent, as well as particular combinations of polymeric stabilizing agents.

However, although such formulations may provide acceptable compositions as far as their physical characteristics are concerned, their detergency is not often fully satisfactory. Furthermore, for particular uses their phase-stability and pourability may not be optimal.

Compositions of the above type are for example disclosed in German Patent Application 2,302,367. In this specification aqueous liquid detergent compositions are described which contain 5–30% by weight of a sodium fatty acid soap, 5–200% by weight of the soap of particular anionic synthetic detergent actives, and 0.1–6% by weight of a vinyl alkylethermaleic anhydride copolymer as stabilizer. These compositions may optionally further contain a nonionic detergent active material, as well as up to 20% of builder salts, such as silicates. Alkalimetal pyro- and tripolyphosphates may also be present, but this is less preferred.

Such systems, which incorporate alkyl-, alkylether- or alkylarylether sulphates as anionic detergent active, do not provide however for satisfactory suspending properties for incorporation of sodiumtripolyphosphate as builder salts therein.

It has now been found that a particular combination of active detergents together with a particular polymeric stabilizing agent provides a satisfactory suspending system for sodiumtripolyphosphate to be formulated into an aqueous liquid detergent composition. In essence, the liquid detergent composition contains five essential ingredients, to wit:

a. a potassium alkylbenzenesulphonate
b. a potassium fatty acid soap
c. a nonionic detergent active material
d. a partially esterified, neutralized copolymer of maleic anhydride with vinylmethylether, ethylene, or styrene
e. sodiumtripolyphosphate.

Not only is the presence of these ingredients essential, but also the relative amounts of these ingredients, as well as the ratio between these ingredients. This is particularly true for the ingredients *a, b* and *c*. These ratios are for a: 3 – 12, preferably 6 – 8%
b: 2 – 8, preferably 3 – 6%
c: 0.5 – 5, preferably 2 – 4%
d: 0.1 – 2, preferably 0.3 – 1.5%
and e: 1 – 25, preferably 15 – 20%, the ratio of *a:b* varying from 1:2 to 6:1, and the ratio of *a:c* from 3:5 to 25:1. The total amount of $a+b+c$ ranges from 7.5–20%.

By a judicious selection of these ingredients within the above specified ranges a suspending system for sodiumtripolyphosphate is obtained which provides an aqueous built liquid detergent composition with a satisfactory phase-stability and pourability.

The first ingredient is potassium alkylbenzenesulphonate, in which the alkyl group is a $C_{10}$–$C_{18}$ branched or straight alkyl chain. In a preferred embodiment of the invention as discussed hereafter, the potassium salt is formed in situ in the composition, but it is also possible to use the potassium alkylbenzenesulphonate salt as such.

The second ingredient is a potassium fatty acid soap, in which the fatty acid radical is derived from $C_8$–$C_{22}$, preferably $C_{10}$–$C_{18}$ saturated or unsaturated fatty acids, including polymerized fatty acids such as dimerized oleic and linoleic acid. Again in the preferred embodiment this potassium soap is formed in situ in the composition, but it may also be used in preneutralized form. It is observed that with a constant amount of ingredient (c), the more of ingredient (b) is used, the less of ingredient (a) is required (but the latter should always be present), and vice versa.

The third ingredient is a nonionic detergent active material. These materials are well-known in the art, and generally consist of an organic hydrophobic radical which has been rendered hydrophilic by reaction with an alkyleneoxide. Typical examples are condensation products of 2–25, e.g. 5–15 moles of ethylene- and/or propylene oxide with primary or secondary $C_9$–$C_{18}$ alcohols, $C_8$–$C_{18}$ alkylphenols, $C_{10}$–$C_{20}$ fatty acid amides and so on. The nonionic detergent active to be used in the present invention should have a cloud point (1% aqueous solution) between 30 and 100, preferably 60° and 100° C. Typical examples are Dobanol® 45–11, a $C_{14}$–$C_{15}$ linear alcohol condensed with 11 moles of ethylene oxide, Tergitol®15-S-9, a sec. $C_{11}$–$C_{15}$ linear alcohol condensed with 9 moles of ethylene oxide, furthermore Ucanol®–87, ex Ugine Kuhlmann, a primary $C_{13}$–$C_{15}$ linear alcohol condensed with 11 moles of ethylene oxide, and Dobanol®25–12, ex Shell, a linear primary $C_{12}$–$C_{15}$ alcohol condensed with 12 moles of ethylene oxide and Dobanol®91–8, a linear primary $C_9$–$C_{11}$ alcohol condensed with 8 moles of ethylene oxide.

The fourth ingredient is a copolymer of maleic anhydride with vinylmethylether, ethylene or styrene, which copolymer has been partially esterified with a small amount of the nonionic detergent active material, the third ingredient mentioned above, and subsequently neutralized with potassium hydroxide. The preferred copolymers are the copolymers of maleic anhydride with vinylmethylether or ethylene. These copolymers, as well as the partially esterified neutralized derivatives thereof as meant in the present application, including the manner of preparing same, are well-known in the art and have been fully described in e.g. U.S. Pat. No. 3,328,309, 3,457,176 and 3,235,505.

Copolymers of vinylmethylether with maleic anhydride are commercially available ex GAF Corp. under the registered trade name of "Gantrez®". These copolymers have a specific viscosity ranging from 0.1 to 4.5 (1 g in 100 ml methylethylketone at 25° C).

The preferred copolymer of this type has a specific viscosity of 0.1–0.5.

Copolymers of maleic anhydride with ethylene are commercially available ex Monsanto Co. under the registered trade name of EMA®, e.g. EMA 11, 21, 31 and 1103. These are linear copolymers, having a viscosity (2% aqueous solution at 25° C) of 2, 5, 7 and 2 cP.

The copolymer, ingredient (d), is partially esterified with a small amount of ingredient (c) in the manner as e.g. described in the above references. The ratio of ingredient (d) to ingredient (c) to obtain the partially esterified copolymer ranges from 50:1 to 1:2.5, preferably from 25:1 to 1:2.5. The partially esterified copolymer is subsequently neutralized, as is also e.g. described in the above references.

Ingredient (e) is sodiumtripolyphosphate, up to 50% and preferably not more than 20% of which may be replaced by potassium tripolyphosphate. The sodiumtripolyphosphate should preferably be of a type which hydrates rapidly, e.g. with a high phase I content, or may already be partially hydrated.

The composition of the invention may furthermore comprise additional ingredients like soil-suspending agents such as CMC, methylcellulose, PVP, PVP/VA, and the like in amounts up to 1%, perfumes, fluorescers, and colouring materials in minor amounts, enzymes, including protease, amylase, cellulases, lipases and mixtures thereof, solvents, hydrotropes, and so on. The pH of the composition is adjusted to a pH-value of at least 10.

In order to further improve the detergency, it is desirable that the composition should also contain an alkalimetal silicate, preferably in an amount of 2 to 10%. The alkalimetal silicate is a sodium silicate with a $Na_2O:SiO_2$ ratio ranging from 1:1 to 1:3.5. The presence of the silicate requires that the final composition has a pH of at least 11, which can be adjusted by means of e.g. KOH.

The compositions of the present invention are prepared by mixing the various ingredients, it being however essential that the stabilizing polymer, ingredient (d), is esterified first with a small amount of the nonionic, ingredient (c). Furthermore, it is essential that ingredients (a) - (d) are mixed with each other first, before the other ingredients are added. If an alkalimetal silicate is incorporated, it is essential that this be added after the sodiumtripolyphosphate has been added.

In a preferred embodiment of the invention, the manufacturing process comprises the steps of 1. dissolving a proportion of ingredient (c) in sufficient water, preferably while heating;
2. adding ingredient (d) to the above solution to partially esterify ingredient (d);
3. adding an excess of KOH to this solution;
4. adding ingredients (a) and (b) in the acid form to the solution obtained by step 3, which contains sufficient KOH to neutralize both the sulphonic acid and the fatty acid;
5. adding the remainder of ingredient (c) to the mixture obtained sub 4, and
6. subsequently adding the sodiumtripolyphosphate, as well as the other optional ingredients. Steps 4 and 5 can be carried out simultaneously.

The compositions of the invention are readily pourable, their viscosity (measured at room temperature with a Brookfield viscosimeter, spindle nr. 3, 30 rpm) ranging from 200–2000 cP. Their phase-stability on standing for 3 months at 37° C, is significantly improved.

The invention will further be illustrated by way of Example.

EXAMPLE I

A stable liquid detergent composition according to the invention was prepared in the following way:

0.3 g of a nonionic detergent ($C_{14-15}$ primary alcohol, condensed with 11 EO) was dissolved in 150 g water. 7.5 g of a copolymer of maleic anhydride with vinylmethylether, having a spec. viscosity of 0.1–0.5 (Gantrez®An–119) were added and the mixture was heated at 80° C till the copolymer was dissolved.

280 g water and 65 g KOH (50% solution) were mixed with the copolymer solution. Subsequently 65 g dodecylbenzene sulphonic acid, 20 g coconut fatty acid and 30 g oleic acid were stirred, which were neutralised in situ by the excess KOH present. After neutralization a further 25 g of the nonionic detergent were added (together with SCMC, fluorescers and dyes as minor ingredients).

Thereafter 30 g potassium tripolyphosphate, 185 g sodium tripolyphosphate and 135 g sodiumsilicate (37% solution, $Na_2O:SiO_2$ = 1:2.5) were added.

The final viscosity of this product was 700 cP. (Brookfield, spindle 3, 30 rpm, 22° C) and the pH was 12.5.

EXAMPLE II

Example I was repeated, however while using the following amounts of dodecylbenzene sulphonic acid, coconut and oleic acid and the nonionic detergent of Example I:

75 g dodecylbenzene sulphonic acid
12.5 g coconut fatty acid
18.5 g oleic acid
35 g nonionic detergent.

The final viscosity was 600 cP and the pH 12.5.

EXAMPLE III

Example I was repeated, using however as ingredients (a), (b) and (c) the following ingredients:

65 g dodecylbenzene sulphonic acid
50 g polymerized oleic acid, comprising 81% dimer and 19% trimer
25 g nonionic detergent.

The final viscosity was 550 cP and the pH 12.5.

EXAMPLE IV

Example III was repeated, using as ingredients (a), (b) and (c):

37 g dodecylbenzene sulphonic acid
66 g polymerized oleic acid
37 g nonionic detergent.

The final viscosity was 650 cP and the pH 12.5.

EXAMPLE V

Example I was repeated, using as ingredients (a), (b) and (c):

0.3 g $C_9$–$C_{11}$ primary alcohol, condensed with 8 moles of ethylene oxide in polymer premix
65 g dodecylbenzene sulphonic acid
20 g coconut fatty acid
30 g oleic acid
25 g of the above nonionic detergent.

The copolymer solution was prepared with 0.3 g of the linear primary $C_9$–$C_{11}$ alcohol condensed with 8 moles of ethylene oxide.

The final viscosity was 900 cP and the pH 12.5.

EXAMPLE VI 1 g of $C_{13-15}$ primary alcohol, condensed with 11 moles of ethylene oxide, was dissolved in 150 g water at 80° C. 5 g of the copolymer of Example I was added, and the resulting mixture was kept at 80° C until the copolymer was dissolved.

Subsequently 280 g water and 65 g KOH (50% solution) were mixed with the copolymer solution, followed by 65 g dodecylbenzene sulphonic acid and 50 g dimeric oleic acid, which were neutralized in situ by the excess KOH present. After neutralization a further 24 g of the above nonionic detergent were added, together with SCMC, fluorescers and dyes as minor ingredients.

Thereafter, 30 g potassium tripolyphosphate, 185 g sodium tripolyphosphate and 135 g sodium silicate (37% solution, $Na_2O:SiO_2 = 1:2.5$) was added.

The final viscosity of this product was 1000 cP, and the pH was 12.5.

EXAMPLE VII

Example VI was repeated, but with 2.5 g of the nonionic in the pre-mix and 22.5 g of the nonionic added after the neutralization.

The viscosity was 950 cP, and the pH 12.5.

EXAMPLE VIII

Repeating Example VI with 5 resp. 6.5 g of the nonionic in the premix and 20 resp. 18.5 g of the nonionic added after the neutralization gave products with a viscosity of 1000 cP resp. 1300 cP and a pH of 12.5 in each case.

I claim:

1. An aqueous, built, liquid detergent composition comprising:

a. 3 to 12 percent of anionic detergent consisting potassium alkylbenzenesulphonate wherein the alkyl is a 10 to 18 carbon, branched or straight alkyl chain;

b. 2 to 8 percent of soap consisting of a potassium salt of a fatty acid derived from an 8 to 22 carbon saturated or unsaturated fatty acid or polymer thereof;

c. 0.5 to 5 percent of nonionic detergent consisting of an alkyleneoxide condensation product of an organic hydrophobic radical;

d. 0.1 to 2 percent of copolymer consisting of the copolymer of maleic anhydride with a compound selected from the group consisting of vinyl methyl ether, ethylene, and styrene, wherein said copolymer has a specific viscosity of 0.1 to 4.5 as a one percent weight/volume solution of said copolymer in methylethylketone at 25° C.; and e. 1 to 25 percent of detergent builder consisting of an alkali metal tripolyphosphate wherein said alkali metal is selected from the group consisting of sodium and potassium; and wherein at least 50 percent of said builder is sodium tripolyphosphate;

wherein said copolymer has been partially esterified with 2 to 250 percent, by weight of said copolymer, of said nonionic detergent and subsequently neutralized.

2. A composition according to claim 1 wherein:

a. said anionic is present at a level of 6 to 8 percent by weight;

b. said soap is present at a level of 3 to 6 percent by weight;

c. said nonionic is present at a level of 2 to 4 percent by weight;

d. said copolymer is present at a level of 0.3 to 1.5 percent by weight; and e. said builder is present at a level of 15 to 20 percent by weight.

3. A composition according to claim 1 wherein said soap is a potassium soap of dimerized oleic acid.

4. A composition according to claim 1, wherein said copolymer is the copolymer of maleic anhydride with vinylmethylether, and wherein said viscosity of said copolymer is 0.1 to 0.5.

5. A process for preparing a composition according to claim 1, comprising:

1. dissolving part of the nonionic detergent active material in sufficient water while heating,
2. adding the copolymer to the resulting solution,
3. adding an excess of potassium hydroxide to the solution,
4. adding the alkylbenzene sulphonic acid and the fatty acid or polymer thereof to the resulting solution,
5. adding the balance of the nonionic detergent active material,
6. subsequently adding the sodiumtripolyphosphate.

6. A process according to claim 5, wherein an alkali-metal silicate is added after the addition of sodium-tripolyphosphate.

* * * * *